United States Patent [19]

Keller et al.

[11] 4,102,088

[45] Jul. 25, 1978

[54] MANHOLE-PIT LINING AND METHOD OF MAKING AND INSTALLING SAME

[76] Inventors: Gustav Keller, Weiperterstr. 10, 8820 Gunzenhausen; Gerhard Enssle, Spitalgasse 1, 8867 Oettingen, both of Fed. Rep. of Germany

[21] Appl. No.: 768,016

[22] Filed: Feb. 14, 1977

[30] Foreign Application Priority Data

Feb. 12, 1976 [DE] Fed. Rep. of Germany ..... 2605535

[51] Int. Cl.[2] ..... E02D 29/14

[52] U.S. Cl. ..... 52/20; 52/182; 52/742; 137/363

[58] Field of Search ..... 137/363; 248/231.1; 182/90–92; 52/19–21, 182, 742

[56] References Cited

U.S. PATENT DOCUMENTS

| | | | |
|---|---|---|---|
| 613,534 | 11/1898 | Swan | 182/90 |
| 1,639,495 | 8/1927 | Frame | 52/20 X |
| 1,755,608 | 4/1930 | Lemmerman | 182/90 X |
| 3,212,519 | 10/1965 | Paschen | 52/21 X |
| 3,258,888 | 7/1966 | Lum | 52/309.3 |

FOREIGN PATENT DOCUMENTS

| | | | |
|---|---|---|---|
| 35,046 | 4/1965 | German Democratic Rep. | 52/21 |
| 1,363,302 | 8/1974 | United Kingdom | 137/363 |

*Primary Examiner*—Alfred C. Perham
*Attorney, Agent, or Firm*—Michael J. Striker

[57] ABSTRACT

A manhole-pit lining is formed of a base, a tubular middle portion, and a top to which a manhole cover is fittable. The base is custom-made in accordance with the particular requirements of the pit being lined. The middle tube provided with pipe connections is then fitted over this base with the pipe connections aligned with the trough formed in the base and is secured thereto by means of an epoxy resin. The middle and base are then placed in an excavation and the pipe connections on the middle are hooked up to the pipes to be joined at the manhole pit. The cover is secured to the top and the excavation is then backfilled. The entire assembly is made of waterproof reinforced concrete and the middle tube itself may be constituted as a standard waterproof pipe section.

13 Claims, 10 Drawing Figures

MANHOLE-PIT LINING AND METHOD OF MAKING AND INSTALLING SAME

BACKGROUND OF THE INVENTION

The present invention relates to a manhole pit. More particularly this invention concerns a unit for lining such a pit and for forming a connection between sewer pipes and the like.

It is known to form a unit for lining a manhole pit starting with a base part constituted as a flat base plate up from which extends a short collar provided with laterally, that is horizontally, extending connections permanently fixed to the collar and positioned so as to align with the underground pipes the manhole pit is to join. Thereafter a so-called channel formation is formed inside the tube, having the necessary radius of curvature and inclination depending on the sizes and relative heights of the pipes being connected. This channel formation must be custom-made for each manhole pit, as each manhole pit must meet particular requirements which are rarely if ever the same for two separate locations.

Since it is essential to be able to form this custom-made channel formation on the spot the upstanding tubular collar on the base plate cannot be more than approximately 100 cm high. If it is made higher, for instance 200 cm – 500 cm the mason forming the channel formation must climb into the base part in order to do the job. This necessitates doing half of the job at one time, then waiting for this half to harden sufficiently to stand on, and then doing the other half. In addition working in such cramped quarters is extremely difficult and often leads to an inferior job.

After the channel formation has been built inside the upstanding collar on the base plate the height of the lining unit is increased by stacking a succession of spacing rings or further collars on the collar and securing them together. The top of this stack is closed by a cover plate normally provided with a hole adapted to receive a manhole cover or adapted to support further spacer rings on top of which the manhole cover is held at ground level.

The formation of such a pit lining is indeed relatively complex. The various construction steps must take place one after the other, and usually time must be allowed between the steps in order to permit the sealing material, concrete, or mortar to cure and harden. Furthermore making such manhole-pit linings is often impossible in very cold or inclement weather.

A further disadvantage of the known manhole-pit linings is that they are often insufficiently strong, and also very frequently leak. Thus it is a common failing that a manhole-pit lining which extends below the water table allows water to seep in through the walls into the sewer system, thereby overloading the system and unnecessarily taxing the water table. It is also possible occasionally for sewage to leak out of such an arrangement into the surrounding ground, often polluting nearby wells. Such leakage most often occurs due to damage occasioned when the hole lining is backfilled. The earth and rocks pushed in around such linings often damage them, in particular at the joints between the respective parts, so that a lining which is constructed to be watertight is made to leak when installed.

Finally, a difficulty with the known manhole-pit linings is that it is necessary for the contractor to stock a great deal of different types of parts in order to be able to form the various linings needed. Furthermore the construction difficulties from lining to lining give uneven results so that the quality will vary greatly from one location to another. It is also extremely difficult for a contractor to calculate just how much time each such lining will take to construct, so that accurate estimation of construction costs and time is almost impossible. Furthermore it is necessary to dig a relatively large hole in order to form such devices in situ, with the corresponding problems of holding back the earth around the excavation, diverting traffic if necessary, and even driving sheet piling in very wet locations.

SUMMARY OF THE INVENTION

It is therefore an object of the present invention to provide an improved manhole-pit lining.

Another object of this invention is to provide such a lining which can be used as a junction between underground pipes.

Yet another object is to provide a manhole-pit lining which overcomes the above-given disadvantages by being relatively easy to construct, quite strong, and completely watertight.

These objects are attained according to the present invention in a manhole-pit lining wherein a base part is formed of a flat base plate and an upwardly extending channel formation, and that thereafter there is fitted over this channel formation a watertight tube provided with laterally projecting pipe connections. A watertight joint is formed between the two thereafter. Both the base part and the tube are made of completely watertight material so that the finished assembly is absolutely watertight and only comprises two separate integral parts which are so firmly bonded together as to constitute a unitary body.

Thus in accordance with the present invention the manhole-pit lining has a custom-made channel formation which corresponds exactly to the particular curvatures and inclinations needed. Once provided with the upwardly extending tube having the laterally projecting pipe connections that are aligned with the channel the assembly can immediately be emplaced, joined to the necessary pipes, and backfilled. Once the base has been custom-made, an operation which cannot be avoided, the entire assembly can be put together in a very short time and emplaced. When an epoxy-type cement is used between the elements to hold them together the curing time is extremely short so that the arrangement can practically be picked up by a crane and placed in the excavation. It is therefore not necessary to keep the excavation open for a long time, nor is it even necessary to provide an excavation which is much larger than the lining to be fitted into it, as the only work that need be carried out in the excavation is the connecting-up of the sewer of water pipes. The floor of the excavation must be prepared and made relatively smooth before installation of the assembled middle and base, an operation which can simply be carried out by pouring sand into the bottom of a rough excavation and smoothing it in a manner known per se in the construction industry.

It is possible to use the assembly according to this invention even in extremely soft ground and well below the water table. The assembly is inherently very watertight so that whatever liquid is inside it is perfectly isolated from whatever surrounds the lining in the ground. Thus the pollution of wells and the like from the sewer lines can be avoided, and similarly the manhole lining can be used in a fresh-water feed system if desired without danger of loosing the fresh-water inside it or contaminating the fresh-water inside through the surrounding ground waters.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

DESCRIPTION OF A PREFERRED EMBODIMENT

Figure 1:
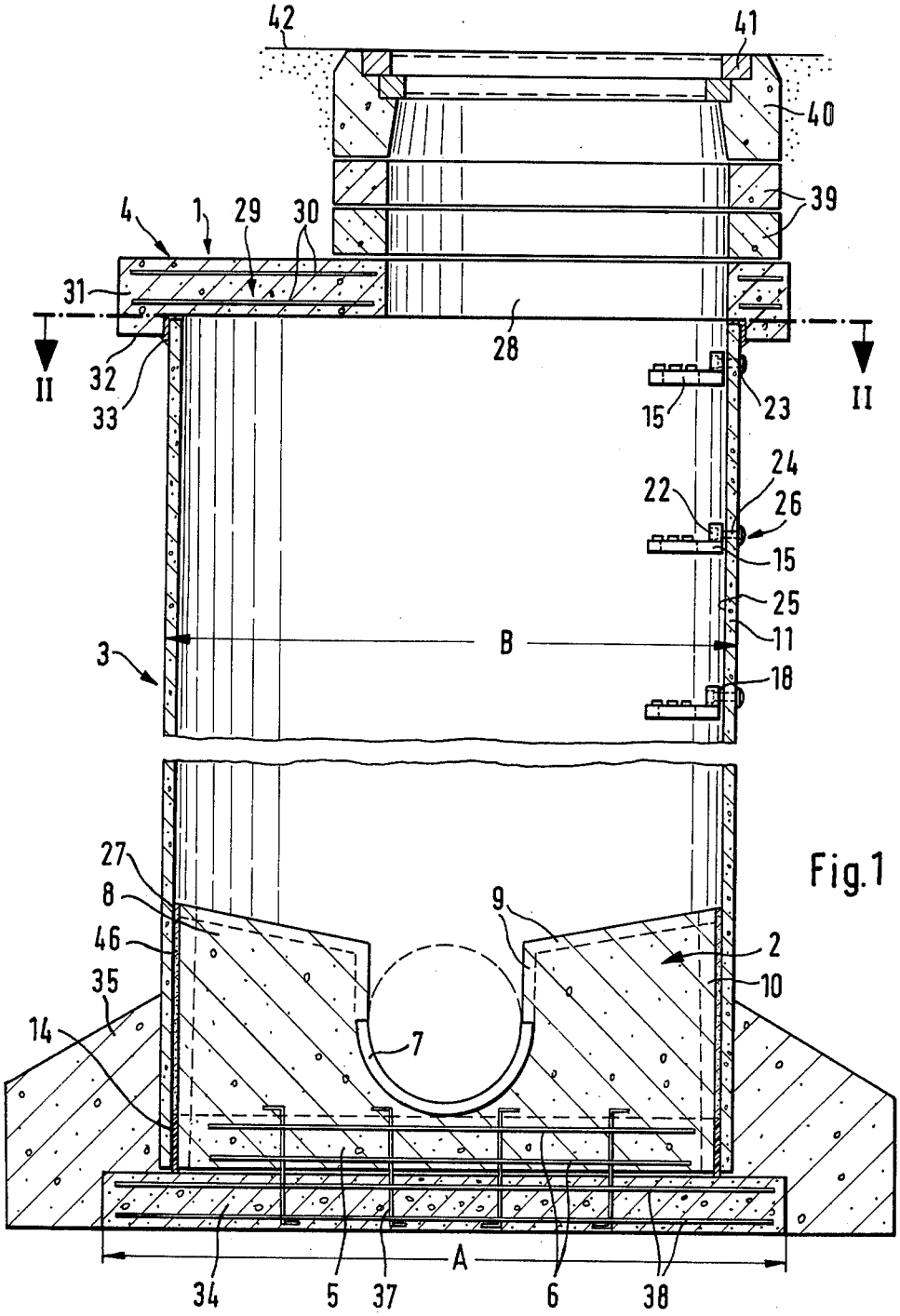
FIG. 1 is a vertical section through a manhole-pit liner according to this invention.

As shown in the drawing the lining 1 according to this invention basically comprises a base 2, an upright tubular middle 3, and a cover or top 4. All of these parts are formed of waterproof concrete, and the tubular middle 3 at least is formed of asbestos concrete.

Figure 2:
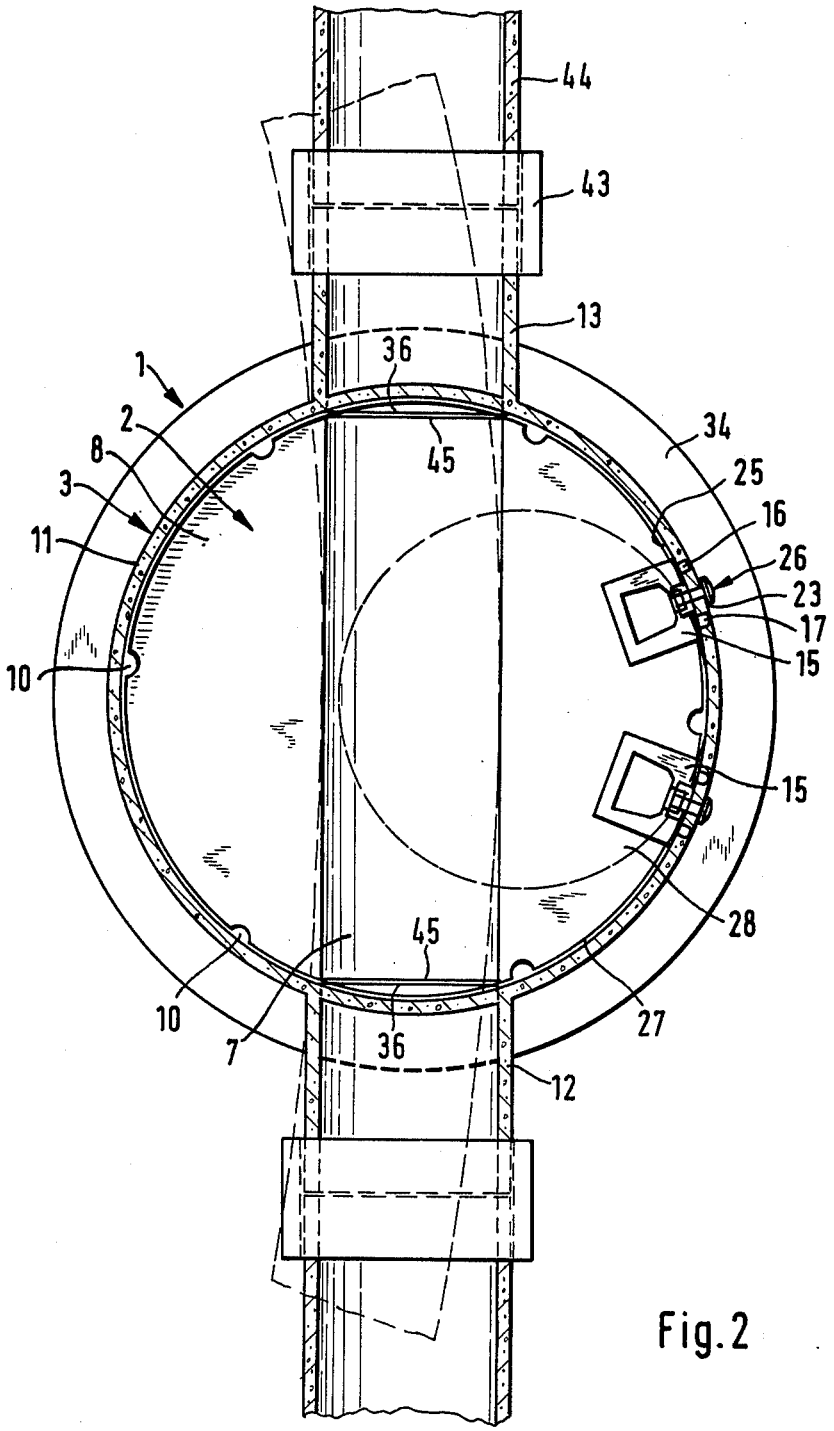
FIG. 2 is a section taken along line II—II of FIG. 1.

The base 2 as shown in FIGS. 1 and 2 comprises a base plate 5 formed as a thick concrete disc provided with steel reinforcement 6. On top of this disc 5 there is formed a custom-made channel formation 8 in which is fitted a semi-cylindrical channel-forming trough or element 7 formed here as a prefabricated straight or curved ready-made part of asbestos concrete. This part may also be custom-made by hand for the particular requirements and has ends of circular shape seen from the top. Underneath the base disc 5 there may be attached a further concrete disc 34 itself provided with reinforcement bars 38 and linked via vertical reinforcement bars 37 to the disc 5 so as to be unitary therewith. The plate 34 has a diameter here equal to approximately 1200 mm. The upper surfaces 9 of the channel formation 8 are inclined toward the channel 7 and are made acid-resistant either by being treated in a manner known in the construction industry, or by being overlain with acid-resistant plates. In addition the formation 8 is formed around its edge with between three and six vertically flaring and downwardly tapering grooves 10.

The middle 3 is constituted as a one-piece tube 11 of asbestos cement having an inner diameter equal to 1000 mm and having an axial height of up to 5000 mm. This tube 11 is of cylindrical shape and is oriented vertically. It fits at its lower end around the formation 8 and is aligned with the lower or bottom surface of the base disc 5, and can rest on the plate 34 if such is provided. Between the inner wall 25 of the tube 11 and the formation 8 there is provided adjacent the base plate 34 an annular mass 14 of epoxy material formed in two stages as described below. Above this ring 14 in the annular cylindrical space 27 between the formation 8 and the inner wall 25 there is provided a mass of acid-resistant sealant mortar 46.

Figure 3:
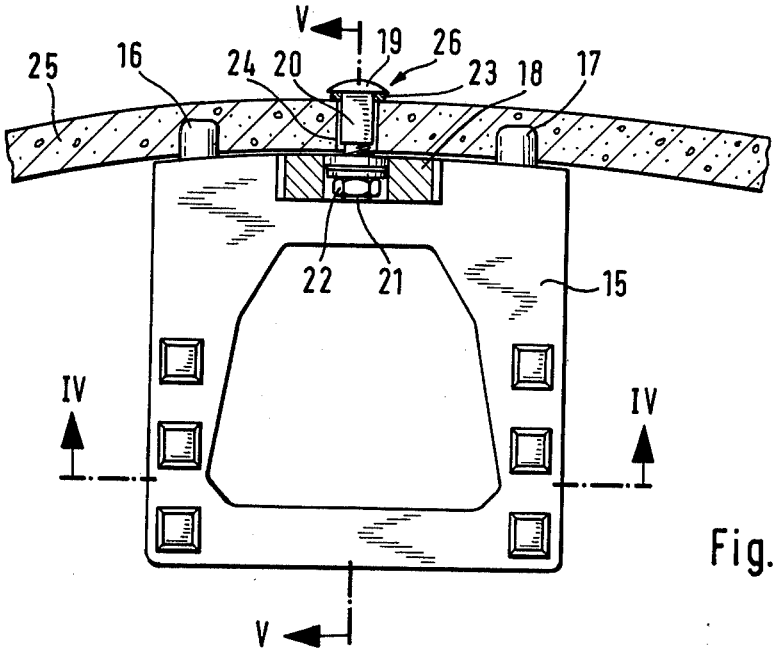
FIG. 3 is a horizontal section through a detail of FIG. 1.
Figure 4:
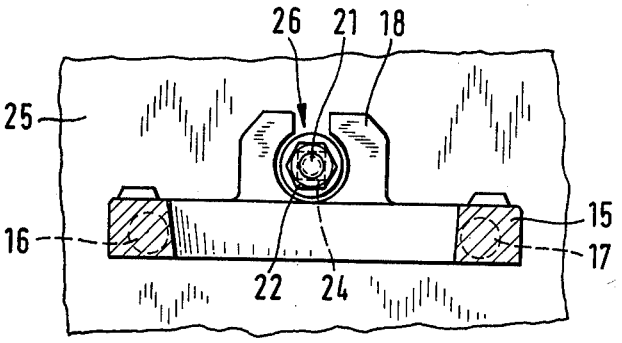
FIGS. 4 and 5 are sections taken along lines IV—IV and V—V of FIG. 3.
Figure 5:
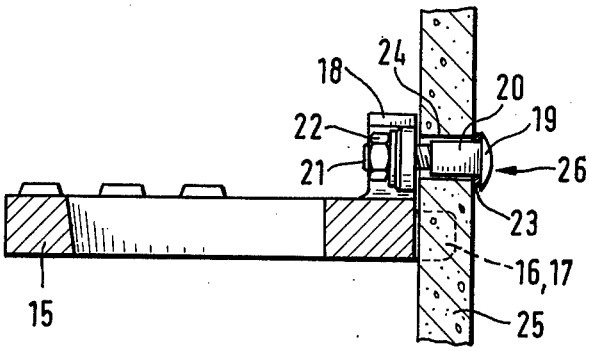

The tube 11 is provided along one side with a plurality of steps 15 of L-shape and each having a vertically extending flange 18 secured by means of a bolt 26 to the tube 7. These bolts 26 have their heads outside the tube and have square-section shanks extending through square-section holes 24 in the tube 11 so that the bolts 26 cannot rotate in these holes 24, as shown in FIGS. 3-5. At their inner ends the bolts are provided with nuts 22 which can be removed after the unit 1 is installed for replacement of the steps 15 is desired without having to gain access to the bolt heads. In addition a sealing washer 23 is provided on the outside of the tube 11 around each of the bolts 26. Thus no leakage can occur through the hole 24. These steps 15 are each formed with centering pins 16 and 17 that fit into corresponding recesses in the inner wall 25 and, due to their position offset from the bolt 26, prevent the steps 15 from tipping.

The tube 11 is further provided in this arrangement with diametrically opposite pipe connections or nipples 12 and 13 that are adapted to be secured by means of connectors 43 to pipes 44 as described below. Although the connections 12 and 13 are here shown to be diametrically opposite each other and at the same axial height relative to the tube 11, they can be axially and angularly offset in any desired configuration, depending on the pipes being joined at the unit 1.

The cover 4 is formed basically as a plate 29 having reinforcing 30 and formed with a throughgoing manhole 28 of smaller internal diameter than the tube 11. The plate 29 is of larger outside diameter than the tube 11 and has a lip 32 extending downwardly from its outer edge 31. A mass 33 of two-component epoxy-type sealant is provided between the inner edge of the lip 32 and the outer edge of the upper end of the tube 11. Spacer rings 39 fit over the top of the hole 28 so as to hold up a collar 40 which supports a manhole cover 41 at the ground level 42.

Figure 6A:
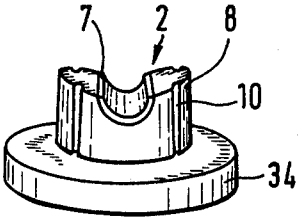
FIGS. 6a-6e are perspective views showing the construction and installation of a manhole-pit lining according to the present invention.

As shown in FIG. 6a the first stage in the formation of the lining 1 as described above is the custom-manufacture at the factory or plant of the base 2.

Figure 6B:
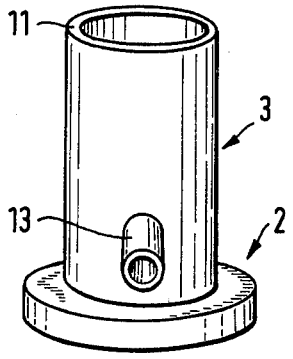

After the base 2 has been formed as shown in FIG. 6b the middle 3 is fitted over it, again at the factory or plant, with the connections 12 and 13 aligned with the trough 7. This middle part 3 has, as mentioned above, an inner diameter of 1000 mm, a height of up to 5000 mm, and a wall thickness of 25 mm. If a taller structure is desired it is possible to join several such tubes 11 longitudinally together by means of a waterproof epoxy-type sealant. These tubes 11 are standard asbestos-cement pipe which come in standardized sizes and lengths. Before the unit 3 is fitted over the formation 8 the inside of the tube 11 is coated with a thick layer of epoxy material which is laid on with a textured trowel to produce an alternately grooved and ridged annular mass inside the lower end of the tube 11 that is allowed to harden by curing for several days. Thereafter the inside of this layer and the outside of the corresponding portion of the base 8 is coated with a freshly mixed layer of a two-component epoxy material. The two elements 3 and 2 are put together and the material 14 between them is cured so that they are ridgedly and fixedly connected together. Once this mass is completely cured a further mass of epoxy material is poured into the space 27 to form a mass 46. The mass 46 is poured in through the flaring grooves 10 so as to form an additional excellent connection between the elements 2 and 3. During this time the relatively thin space 45, having a width of between 10 mm and 25 mm, here 15 mm, is filled with an acid and water-resistant mass 36 again of epoxy resin.

Thus smooth flow can be assured between the connections 12 and 13 through the trough 7. The resins forming the masses 14 and 36 cure very rapidly, and a similar fast-hardening mortar is used for the mass 46.

Figure 6C:
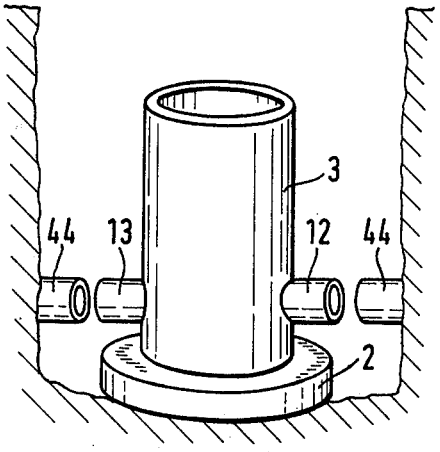

The assembly shown in FIG. 6b is then transported from the factory or plant by means of a truck or the like to the site. As shown in FIG. 6c the middle 3 and base 2 are then implaced in an excavation with the connections 12 and 13 aligned with pipes 44.

Figure 6D:
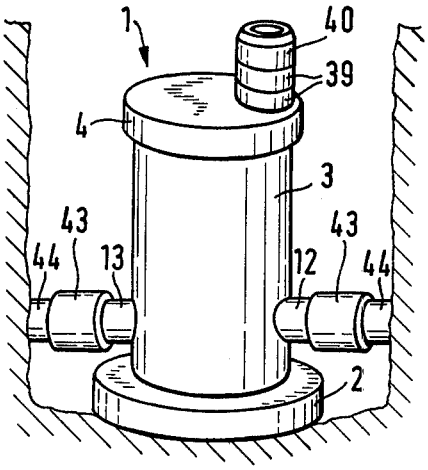

Thereafter as shown in FIG. 6d couplings 43 are fitted over the connections 12 and 13 to secure them to the pipes 44 in a manner well known in the art. At the same time the top 4 is fitted to the upper end of the middle 3 with the mass 33 securing them together. Again the mass 33 may be an epoxy-type resin to insure that the arrangements remains watertight. It is noted in this regard that the top 4 can be fitted to the base and middle 2 and 3 at the plant prior to delivery to the site.

At this time it is possible to form a large ring 35 of concrete around the bottom of the assembly, in order to hold it down in locations where the water table is above the bottom of the unit. Such a large ring 35 also serves to support and stabilize the assembly.

Figure 6E:
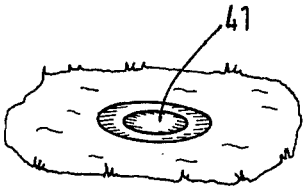

Finally as shown in FIG. 6e, the excavation is completely back-filled so that only the manhole cover 41 remains visible. Access can easily be had to the interior of this manhole-pit lining through the cover 41. The assembly can be done in very short order and the finished unit will have considerable structural strength so as not to be damaged when the excavation is back-filled. Furthermore the lining will be completely watertight so as to prevent sewage or other liquid inside it from mixing with the surrounding ground water and vice versa.

It will be understood that each of the elements described above, or two or more together, may also find a useful application in other types of constructions differing from the types described above.

While the invention has been illustrated and described as embodied in a manhole-pit lining, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of making a manhole-pit lining for an excavation of predetermined depth at which meet a plurality of conduits, said method comprising the steps of sequentially:

(a) forming a base part with a base plate and extending upwardly therefrom a channel formation custom-made to be alignable with said conduits;

(b) fitting over said channel formation a watertight tube provided with laterally projecting pipe connections aligned with said channel formation and alignable with said conduits;

(c) permanently securing said tube to said base part with a watertight joint;

(d) implacing said base part and tube in said excavation;

(e) aligning said connections with said conduits;

(f) forming a watertight joint between each of said connections and a respective one of said conduits; and (g) back filling said excavation around said tube and base part.

2. The method defined in claim 1, wherein said joint of step (c) is formed by coating the inside of the lower end of said tube with a first curable layer, thereafter curing said first layer, thereafter coating said first layer and a portion of the outside of said formation with an adhesive, and thereafter fitting said tube in formation together with the coated regions with contact with each other and curing same.

3. The method defined in claim 2, wherein said joint of step (c) is further formed by filling an annular region above said coated region and defined between said tube and said formation with a nonshrink, acid-resistant, and solid crack-free hardenable mass and thereafter hardening said mass.

4. The method defined in claim 3, wherein after formation of said joint of step (c) a formation is cast in said tube above said joint.

5. The method defined in claim 1, wherein said base part is formed with metal reinforcement extending into said channel formation.

6. The method defined in claim 1; further comprising the step (e) of fitting a cover provided with a manhole over the upper end of said tube and forming a watertight joint between said cover and said tube.

7. The method defined in claim 1; further comprising the step (h) of forming said tube of a length shorter than the depth of said excavation.

8. A manhole-pit lining comprising:

a base part having a base plate and a channel formation unitarily formed therewith;

an upwardly tubular middle part having a lower end fitted around said channel formation, an upwardly open upper end, and at least one laterally extending pipe connection between said ends and aligned with said channel formation, said middle part being formed with a plurality of horizontally throughgoing polygonal-section holes;

a step inside said middle part at each of said holes;

a bolt having a polygonal-section shank received snugly in each of said holes and each securing a respective step to said middle part;

a watertight joint between and rigidly fixing together said lower end of said middle part and said base part; and a cover part including a manhole cover secured over said upper end.

9. The lining defined in claim 8, wherein said middle part is formed of asbestos cement, said base plate and said cover part being formed of steel reinforced concrete, and said channel formation being formed of light concrete.

10. The lining defined in claim 8, wherein said channel formation is formed with a plurality of upwardly flaring grooves opening laterally toward said lower end of said middle part, said joint including a nonshrink, acid-resistant, and solid crack-free mass at said grooves engaging said formation and said lower end of said middle part.

11. The lining defined in claim 8, wherein said channel formation is formed with a plurality of upwardly flaring grooves opening laterally toward said lower end of said middle part at said joint.

12. The lining defined in claim 1, wherein said lower end of said middle part abuts said base part and forms an annular gap around said channel formation, and joint being in said gap.

13. The lining defined in claim 8, wherein said steps each have a horizontal leg projecting into said tube and a vertical leg lying against the inner surface of said tube at a respective one of said throughgoing holes.

* * * * *